US007614967B1

(12) United States Patent
Lewis

(10) Patent No.: US 7,614,967 B1
(45) Date of Patent: Nov. 10, 2009

(54) METHOD FOR PRACTICING PITCHING AND SYSTEM THEREFOR

(76) Inventor: Joseph Edwin Lewis, 29700 Skyline Dr., Tehachapi, CA (US) 93561

( * ) Notice: Subject to any disclaimer, the term of this patent is extended or adjusted under 35 U.S.C. 154(b) by 150 days.

(21) Appl. No.: 11/980,031

(22) Filed: Oct. 30, 2007

Related U.S. Application Data

(63) Continuation-in-part of application No. 11/654,199, filed on Jan. 17, 2007, now Pat. No. 7,470,202, and a continuation-in-part of application No. 10/961,551, filed on Oct. 8, 2004, now Pat. No. 7,435,194.

(60) Provisional application No. 60/516,467, filed on Nov. 1, 2003.

(51) Int. Cl.
*A63B 69/00* (2006.01)
*A63F 7/20* (2006.01)

(52) U.S. Cl. ..... 473/454; 473/422

(58) Field of Classification Search ..... 473/422, 473/454–456; 273/317.6, 317.7, 317.9
See application file for complete search history.

(56) References Cited

U.S. PATENT DOCUMENTS 376,628 A * 1/1888 Bowen ..... 273/108
884,462 A * 4/1908 Bryant ..... 473/455
1,220,980 A * 3/1917 Griesel ..... 273/317.6
3,871,647 A * 3/1975 Tellez ..... 473/451
4,781,376 A 11/1988 Barnes, Sr.
5,433,434 A 7/1995 Helmetsie
5,527,185 A * 6/1996 Davis ..... 473/438
5,566,935 A 10/1996 Meharg
D376,396 S * 12/1996 Nelson ..... D21/780
6,322,461 B1 * 11/2001 Walsh ..... 473/422
6,350,211 B1 2/2002 Kolmar
2005/0090337 A1 4/2005 Ross et al.

* cited by examiner

*Primary Examiner*—Mitra Aryanpour
(74) *Attorney, Agent, or Firm*—Ted Masters

(57) ABSTRACT

A system for practicing pitching includes a batter mannequin which is selectively movable to a right handed batting position or to a left handed batting position. A catcher mannequin is disposed behind home plate, and is selectively movable along a transverse path. The catcher mannequin has a mitt which may be selectively moved up or down. The various movements of the batter mannequin and the catcher mannequin may be controlled from a practice pitching area.

1 Claim, 8 Drawing Sheets

Fig. 16
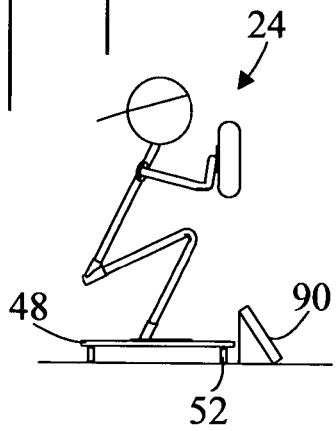
Fig. 17
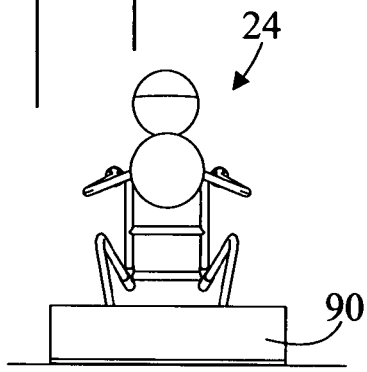
Fig. 18
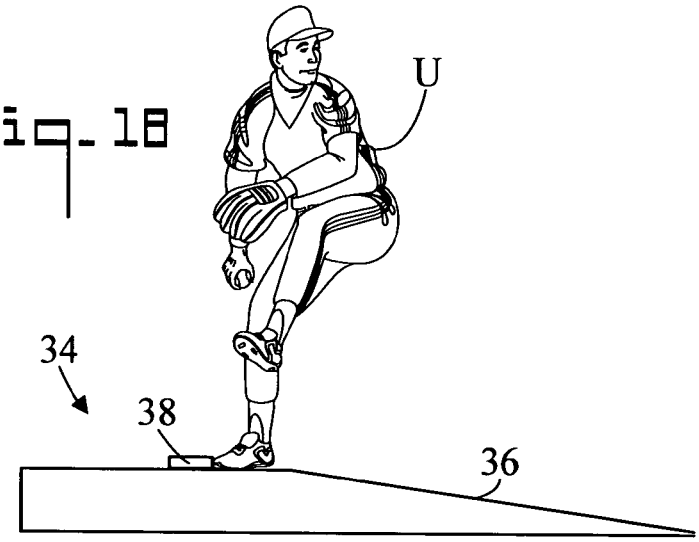
Fig. 19
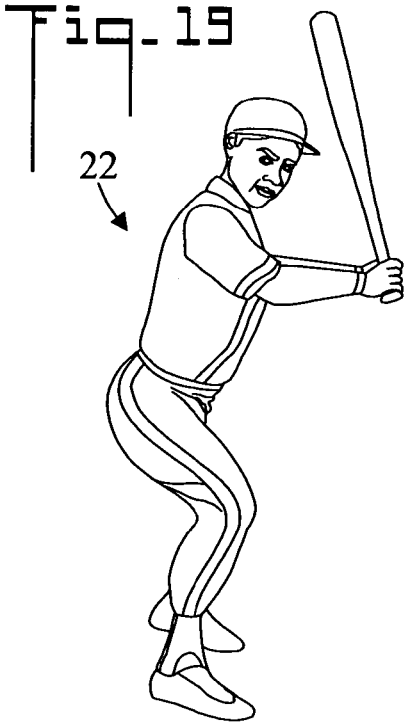
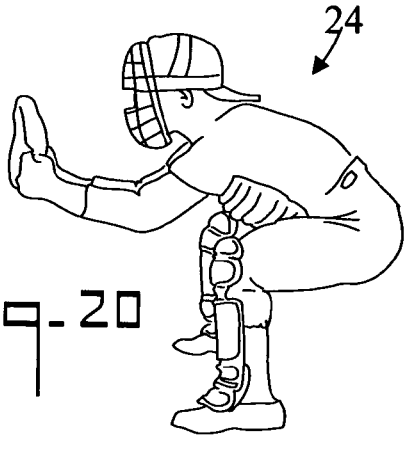
Fig. 20

METHOD FOR PRACTICING PITCHING AND SYSTEM THEREFOR

This application is a Continuation-In-Part of and claims the filing benefit under 35 U.S.C. § 120 of (1) application Ser. No. 10/961,551, filed Oct. 8, 2004 now U.S. Pat. No. 7,435,194, which is herein incorporated by reference, and which claims the filing benefit of Provisional Application No. 60/516,467 filed Nov. 1, 2003, and also (2) application Ser. No. 11/654,199, filed Jan. 17, 2007 now U.S. Pat. No. 7,470,202, which is herein incorporated by reference.

TECHNICAL FIELD

The present invention pertains generally to the games of baseball and softball, and more particularly to a method and system for practicing pitching in which a batter mannequin and catcher mannequin are selectively positioned with respect to home plate.

BACKGROUND OF THE INVENTION

In the game of baseball or softball a pitcher attempts to throw a ball from a pitching area so that the ball crosses over home plate. The batter is positioned adjacent to home plate and attempts to hit the thrown ball with a bat. Batter's cages emulate this action wherein a batter stands adjacent to home plate while a baseball pitching machine throws balls toward the plate. The batter attempts to hit the thrown balls and thus improves his or her batting skills.

BRIEF SUMMARY OF THE INVENTION

The present invention is directed to a method and system for practicing pitching a baseball or a softball. The system includes a life-like batter mannequin which may be moved to either a right handed batting position or a left handed batting position. The batter mannequin has a rotatable head which may be positioned so the batter mannequin looks at the pitcher in either the right handed batting position of the left handed batting position. The system also includes a life-like catcher mannequin which moves transversely behind home plate, and a catcher's mitt which may be positioned up or down. The transverse movements of the catcher mannequin and the up and down movement of the catcher mannequin's mitt are remotely controlled from a desired location, such as at the pitching area (i.e. pitcher's mound/rubber). For example, a pitching coach could be located at the pitching area, and could both provide instructions to the pitcher (the user), and also control the movement of the catcher and the catcher's mitt.

The system of the present invention allows someone of any ability to practice pitching a baseball/softball at a three-dimensional target which replicates the most real circumstances as possible without requiring the presence of another human being. The pitcher can practice throwing in a life-like environment, for example by throwing to the location of the mannequin catcher's mitt.

In an embodiment of the invention, the batter mannequin will be in complete baseball uniform and will be positioned in the batters box in a ready position looking at the pitching area. The catcher mannequin will similarly be in complete baseball uniform including catcher's gear and positioned behind home plate in a receiving position with the catcher's mitt extended in front. Both mannequins consist of a metal framework surrounded by a durable foam to fill out the bodies. The mannequins are then painted or alternatively dressed in full baseball uniforms to simulate the exact look and feel that a pitcher has when pitching in an actual baseball game. Additionally, the mechanical mannequins can be sculpted to look exactly like any major league baseball player, so a person could be pitching to someone famous like "Sammy Sosa" batting and "Pudge Rodriguez" catching.

The transverse movement of the catcher mannequin, and the up and down movement of the catcher mannequin's mitt, can be controlled with pulley systems, or conversely could be automated using a chain drive or other movement mechanism and cooperating electronics.

The present invention can be used in an established batting cage, Major League baseball parks, Major League Bullpens, entertainment fun parks, high schools, colleges, professional baseball/softball teams and any individuals who will like to practice their pitching skills. The present invention is not gender or age specific. The mechanical mannequins can be developed as either a male or female and can be made for any age level and used in baseball or softball environments.

The mechanical mannequins can be manufactured as adult sized where someone would be pitching from 60 feet 6 inches. Alternatively, the mechanical mannequins can be manufactured as little league sized where someone would be pitching from the standard little league pitching distance. The mechanical mannequins can be manufactured as women softball players where softball players can practice their pitching skills.

Other embodiments of the invention can also include:

- A baseball dispensing machine which dispenses baseballs when someone inserts money.
- A cage like environment consisting of netting or chain link fencing to keep the balls within a restricted area.
- A ball return system that will allow the balls to be brought back to a designated area.
- A speed radar that will indicate the velocity of the thrown ball.
- A video camera that will record the pitcher's mechanics.
- A backdrop picture of fans which is inserted behind the catcher to replicate reality.

In accordance with a preferred embodiment of the invention, a system for practicing pitching includes a home plate, a pitching area, a batter mannequin, and a catcher mannequin. The batter mannequin is disposed upon a first foundation which is not rotatably connected to home plate, and the batter mannequin is selectively movable to a right handed batting position or to a left handed batting position. The catcher mannequin is disposed upon a second foundation which is disposed behind home plate, and the catcher mannequin is selectively moveable with respect to home plate along a transverse path.

In accordance with an aspect of the invention, the first foundation includes rolling means for selectively rolling first foundation to either a right side of home plate or to a left side of home plate so that batter mannequin assumes either a right handed batting position or a left handed batting position respectively.

In accordance with another aspect of the invention, the rolling means includes two wheels connected to the first platform.

In accordance with another aspect of the invention, the pitching area includes an elevated pitching platform upon which a user stands.

In accordance with another aspect of the invention, the elevated pitching platform has a sloping portion which slopes downward toward home plate.

In accordance with another aspect of the invention, the batter mannequin has a body which is bilaterally symmetrical about a vertical median plane. The batter mannequin has hands which are centered out in front of the body and which reside upon the vertical median plane, and the hands holding a bat which is bisected by the vertical median plane.

In accordance with another aspect of the invention, the batter mannequin has a rotatable head which is manually rotatable to (1) a left-looking position when the batter mannequin is in a right handed batting position so that the batter mannequin looks at the pitching area, and (2) a right-looking position when the batter mannequin is in a left handed batting position so that the batter mannequin looks at the pitching area.

In accordance with another aspect of the invention, the second foundation having wheels for transversely moving the catcher mannequin.

In accordance with another aspect of the invention, an angled guard is disposed in front of the second foundation.

In accordance with another aspect of the invention, a first pulley system controls the transverse movement of the catcher mannequin.

In accordance with another aspect of the invention, the first pulley system has a control which is disposed at the pitching area.

In accordance with another aspect of the invention, the catcher mannequin has a mitt which is selectively moveable in a vertical direction.

In accordance with another aspect of the invention, a second pulley system has a control which controls the vertical movement of the catcher mannequin's mitt.

In accordance with another aspect of the invention, the second pulley system has a control which is disposed at the pitching area.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 16 is a side elevation view of the catcher mannequin and an angled guard;

FIG. 17 is a front elevation view of the catcher mannequin and the angled guard;

FIG. 18 is a side elevation view of an elevated pitching platform with a user pitching;

FIG. 19 is a front elevation view of a filled out batter mannequin wearing a uniform; and, FIG. 20 is a side elevation view of a filled out catcher mannequin wearing a uniform.

DETAILED DESCRIPTION OF THE INVENTION

Figure 1:
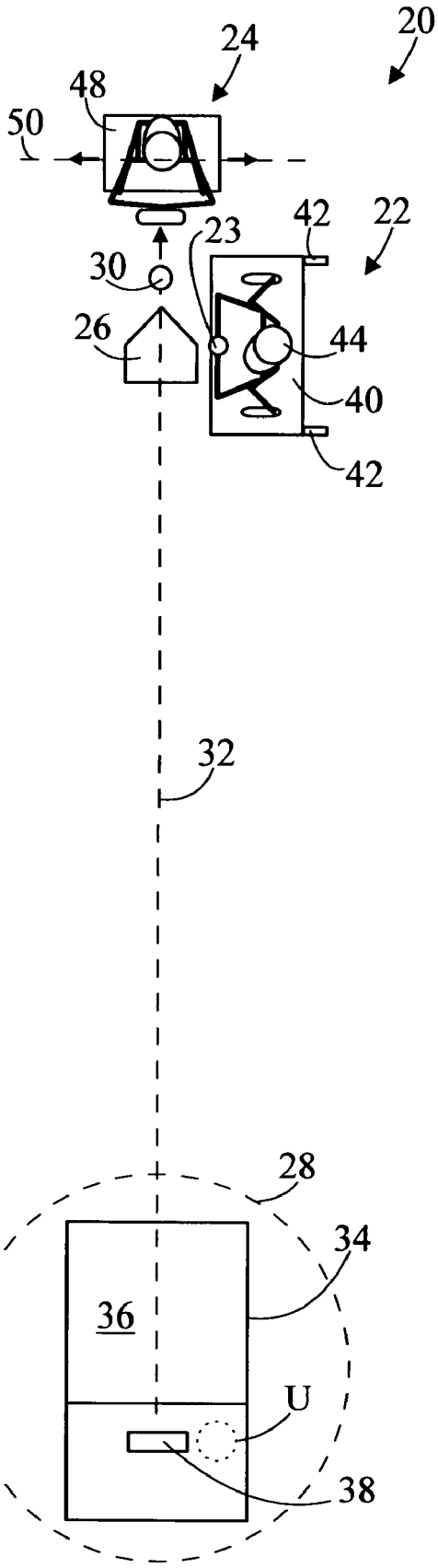
FIG. 1 is a reduced top plan view of a system for practicing pitching in accordance with the present invention.
Figure 2:
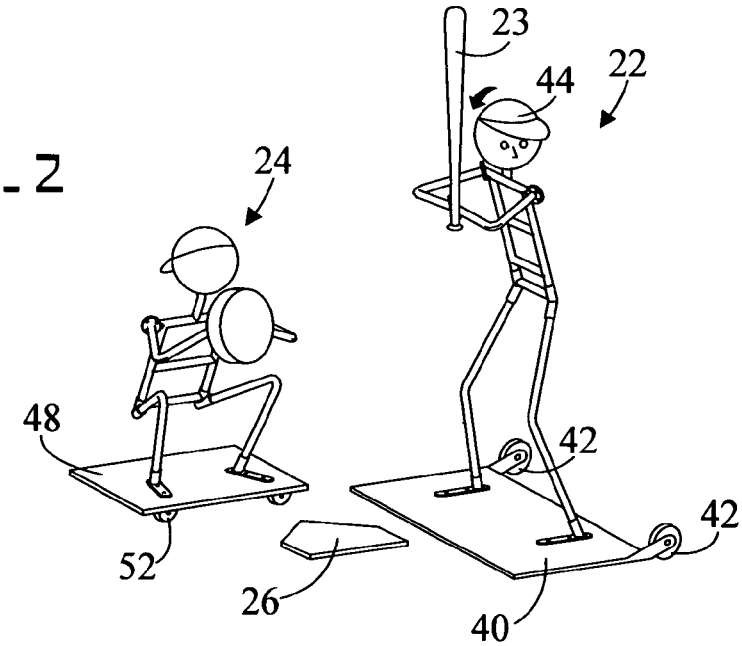
FIG. 2 is a front perspective view of a batter mannequin in a right handed batting position, and a catcher mannequin.
Figure 3:
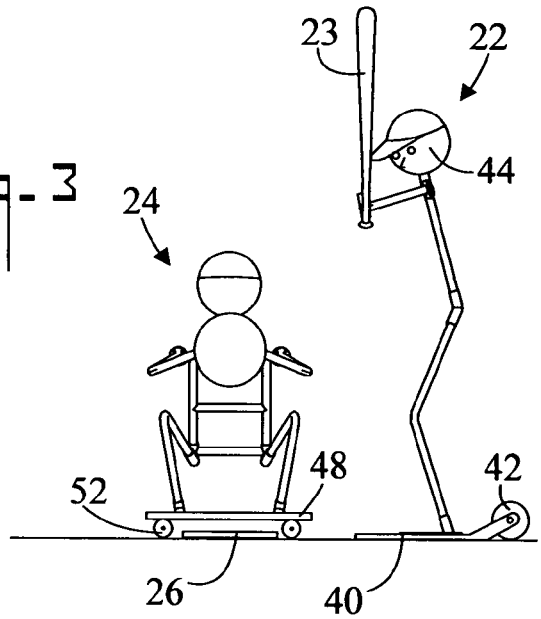
FIG. 3 is a front elevation view of the batter mannequin and the catcher mannequin.
Figure 4:
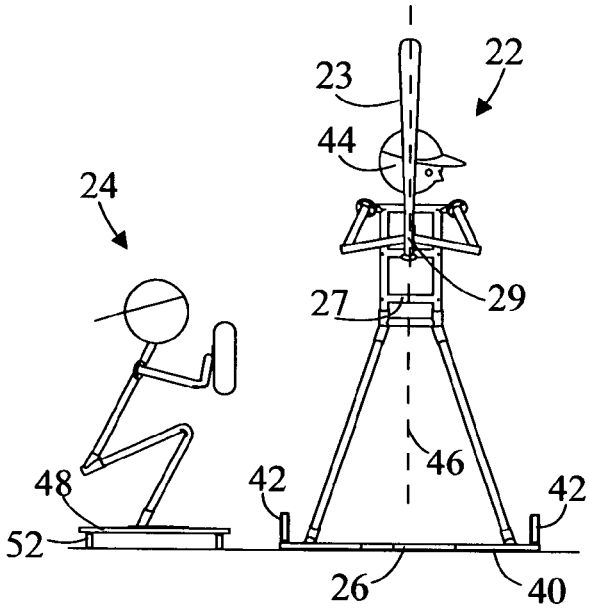
FIG. 4 is a side elevation view of the batter mannequin and the catcher mannequin.

Referring initially to FIG. 1, there is illustrated a reduced top plan view of a system for practicing pitching in accordance with the present invention, generally designated as 20. FIGS. 2-5 show various views of a batter mannequin 22, a catcher mannequin 24, and home plate 26. In FIGS. 2-4 batter mannequin 22 is in a right handed batting position, and in FIG. 5 batter mannequin 22 is in a left handed batting position. System 20 includes a batter mannequin 22 who holds a bat 23, a catcher mannequin 24, a home plate 26, and a pitching area 28. Home plate 26 is the conventional five-sided plate used in the game of baseball or softball. A user U (the person practicing pitching, also refer to FIG. 18) is disposed at pitching area 28, and throws a ball 30, for example a baseball or a softball, along a general line of flight 32 toward home plate 26 as is done in the real games of baseball or softball. Pitching area 28 includes an elevated pitching platform 34 upon which user U stands to pitch ball 30. Elevated pitching platform 34 has a sloping portion 36 which slopes downward toward home plate 26, and a pitching rubber 38. Elevated pitching platform 34 emulates the pitcher's mound in the real game of baseball.

In the drawings, batter mannequin 22 and catcher mannequin 24 are shown only as frames. However, it may be appreciated that batter mannequin 22 and catcher mannequin 24 comprise life size replicas of ball players wherein the frames are surrounded with a polymer or other material which fills out their bodies so that they have a realistic appearance (refer also to FIGS. 19 and 20). In a possible embodiment of the invention a 8 lb. self skinning flexible foam is molded around the frames to fill out the bodies of the mannequins. Such a foam is available from BJB Enterprises, Inc., 14791 Franklin Ave., Tustin, Calif. 92780, under the product number TC-280 A/B. Additionally, the mannequins may be painted to simulate a uniform, or alternatively may wear an actual uniform. Furthermore, the bodies, faces, and uniforms of the mannequins may even be designed to look like a famous player.

Figure 5:
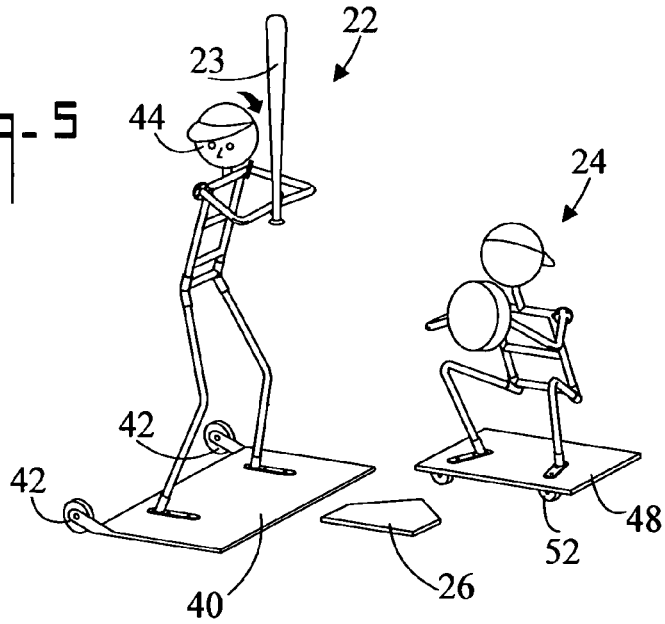
FIG. 5 is a front perspective view of the batter mannequin in a left handed batting position, and a catcher mannequin.
Figure 13:
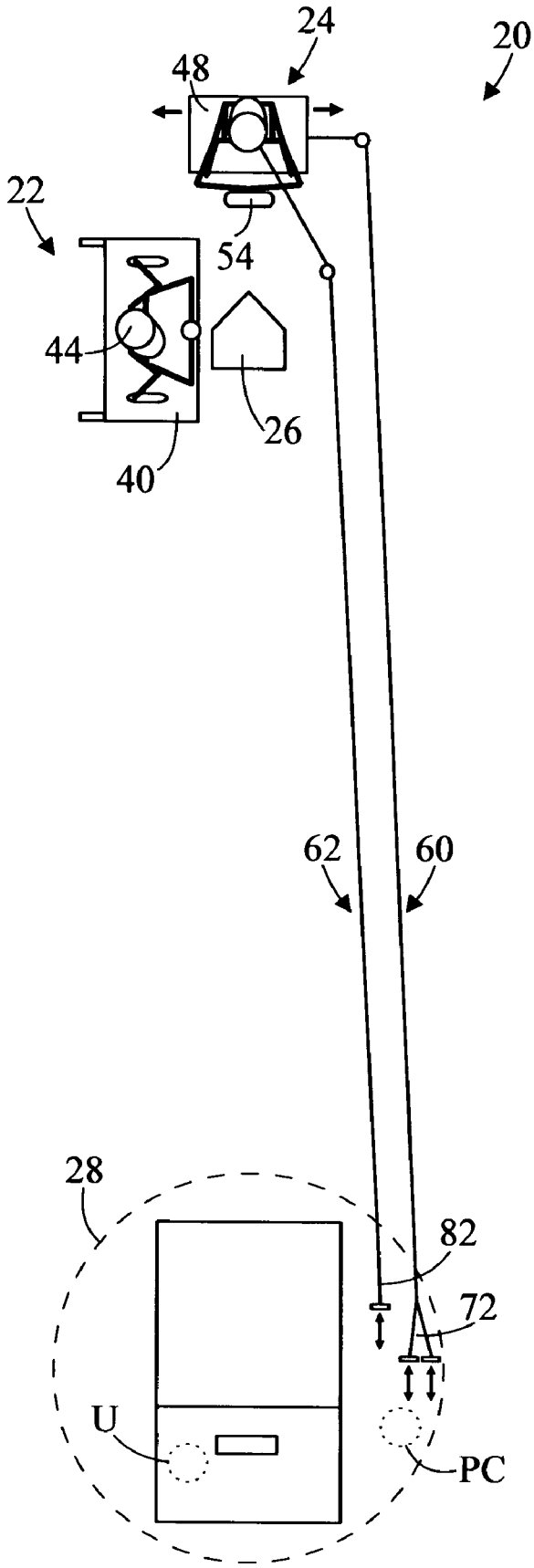
FIG. 13 is a reduced top plan view of the system showing pulley systems for controlling the transverse position of the catcher mannequin and the vertical positioning of the catcher mannequin's mitt.

Batter mannequin 22 is disposed upon a first foundation 40 which is not rotatably connected to home plate 26, and batter mannequin 22 is selectively movable to a right handed batting position as shown in FIGS. 1-4, or to a left handed batting position as shown in FIGS. 5 and 13. In an embodiment of the invention, first foundation 40 is a rectangular plate and includes rolling means for selectively rolling first foundation 40 to either a right side of home plate 26 (as is shown in FIGS. 1-4), or to a left side of home plate 26 (as is shown in FIGS. 5 and 13) so that batter mannequin 22 assumes either a right handed batting position or a left handed batting position respectively. It is noted that in both batting positions, the body of batter mannequin 22 generally faces home plate 26. In the shown embodiment of the invention, the rolling means includes two wheels 42 which are connected to the back edge of first platform 40.

It is important to note that in the present invention batter mannequin 22 does not rotate about home plate 28 (such as on a turntable) as was disclosed in cross-referenced patent application Ser. No. 10/961,551. Rather batter mannequin 22 is moved (such as by rolling) to either a right handed batting position as in FIG. 2, or to a left handed batting position as in FIG. 5. That is, batter mannequin 22 can be moved from one side of home plate 28 to the other side of home plate to effect either the right handed or left handed position as may be desired.

In another embodiment of the invention, batter mannequin 22 has a rotatable head 44 which is manually rotatable to (1) a left-looking position when batter mannequin 22 is in the right handed batting position so that batter mannequin 22 looks at pitching area 28 (refer to FIGS. 1, and. 2), and (2) a right-looking position when batter mannequin 22 is in a left handed batting position so that batter mannequin 22 looks at pitching area 28 (refer to FIGS. 5 and 13).

Referring to FIGS. 2, 4, and 5, the use of one batter mannequin 22 for both right handed and left handed batting positions is made possible by the symmetrical design of batter mannequin 22. When viewed from the front (as in FIG. 4), batter mannequin 22 has a body 27 (including the torso, upper arms, legs, and feet) which is bilaterally symmetrical about a vertical median plane 46 (shown on end in FIG. 4). Because of this feature, body 27 of batter mannequin 22 looks the same in either the right handed or left handed batting positions. Further, batter mannequin 22 has hands 29 which are centered out in front of said body and which reside upon said vertical median plane. Referring to FIG. 4, hands 29 are defined as the intersection of the batter mannequin's 22 lower arms with bat 23. As such, hands 29 hold bat 23 which projects upwardly and is substantially bisected by vertical median plane 46.

Returning to FIGS. 1-5, catcher mannequin 24 is disposed upon a second foundation 48 which is disposed behind home plate 26 in the classical baseball arrangement. Catcher mannequin 24 is selectively positionable with respect to home plate 26 along a transverse path 50 (refer to FIG. 1). Transverse path 50 is substantially perpendicular to line of flight 32 of ball 30. As used herein "disposed behind home plate 26" means that catcher mannequin 24, batter mannequin 22, and home plate 26 are in the same relationship as in an actual game of baseball or softball, wherein the batter is disposed between the pitching area and the catcher, and home plate is also generally disposed between the pitching area and the catcher.

Second foundation 48 has wheels 52 for transversely moving catcher mannequin 24. This feature of the present invention simulates the catcher moving to the outside or inside corner of the plate as is done in the actual game of baseball or softball.

Figure 6:
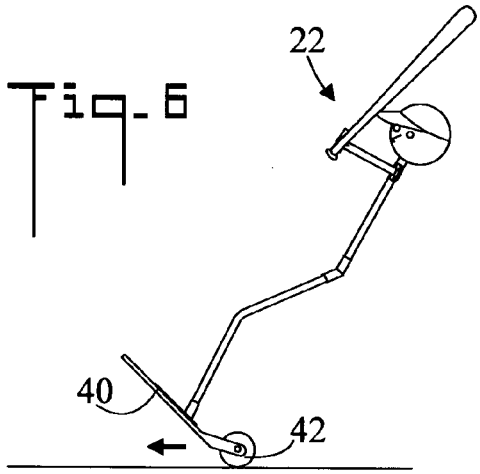
FIG. 6 is a side elevation view of the batter mannequin being moved.

FIG. 6 is a side elevation view of the batter mannequin 22 being moved. Batter mannequin is tilted and then rolled on wheels 42.

Figure 7:
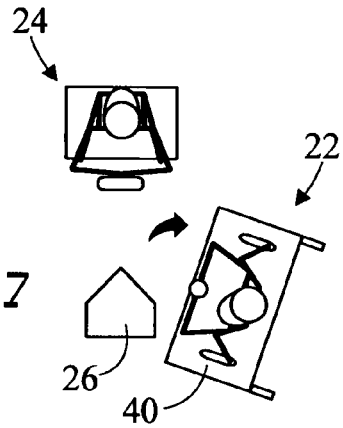
FIG. 7 is a reduced top plan view of the batter mannequin in a closed batting stance.

FIG. 7 is a reduced top plan view of batter mannequin 22 in a closed batting stance. Platform 40 has been rotated in the shown direction. This is to simulate reality because not every batter stands the same way in the batter's box.

Figure 8:
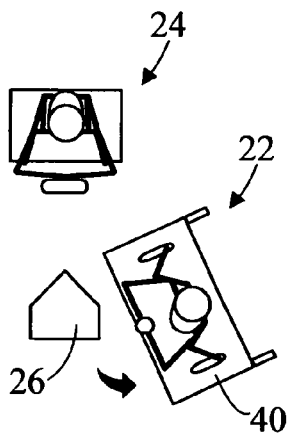
FIG. 8 is a reduced top plan view of the batter mannequin in an open batting stance.

FIG. 8 is a reduced top plan view of batter mannequin 22 in an open batting stance. Platform 40 has been rotated in the shown direction, opposite to the direction of FIG. 7.

Figure 9:
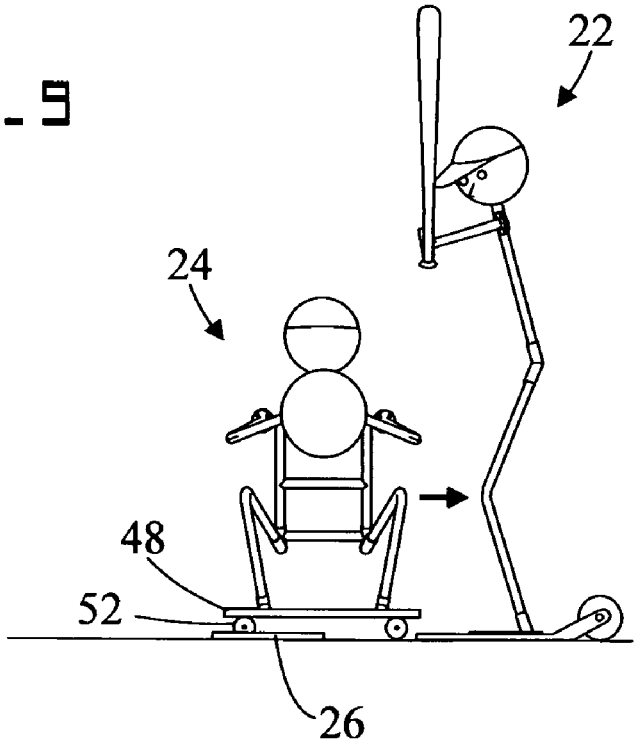
FIG. 9 is a front elevation view of the catcher mannequin transversely moved to the right.

FIG. 9 is a front elevation view of catcher mannequin 24 transversely moved to the right. To effect the movement, second platform 48 is rolled right on wheels 52.

Figure 10:
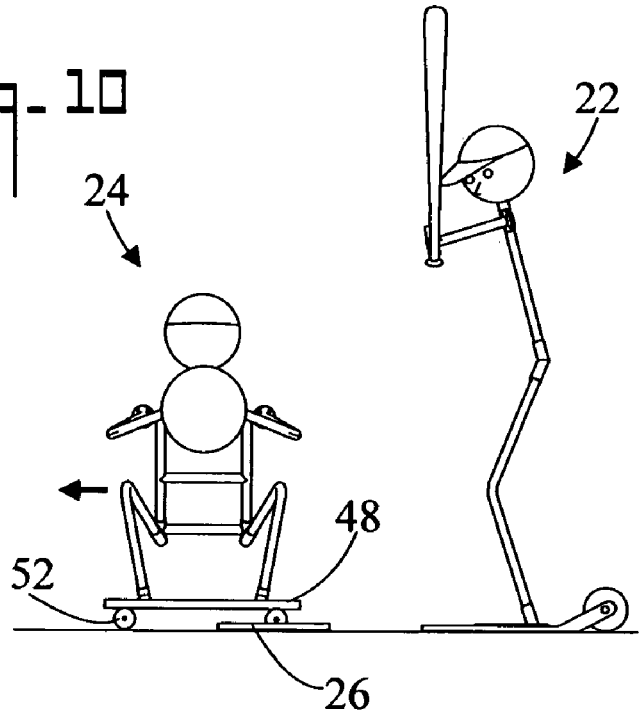
FIG. 10 is a front elevation view of the catcher mannequin transversely moved to the left.

FIG. 10 is a front elevation view of catcher mannequin 24 transversely moved to the left. To effect the movement, second platform 48 is rolled left on wheels 52.

Figure 11:
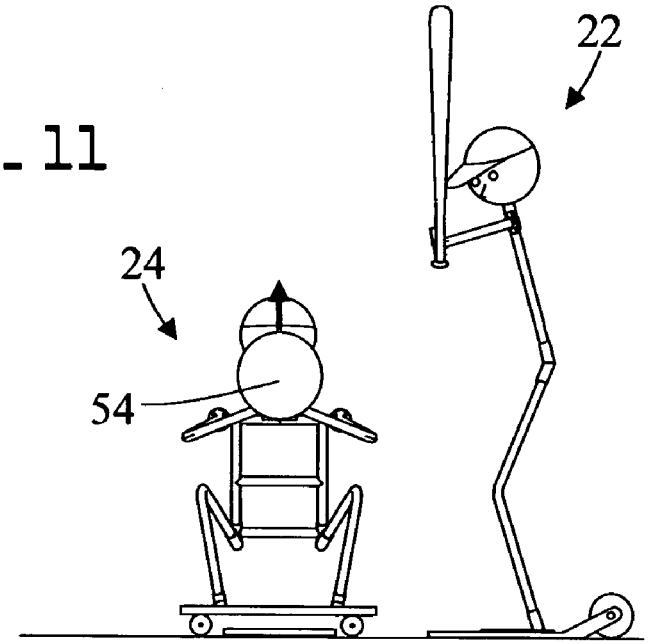
FIG. 11 is a front elevation view of the catcher mannequin's mitt moved up.
Figure 12:
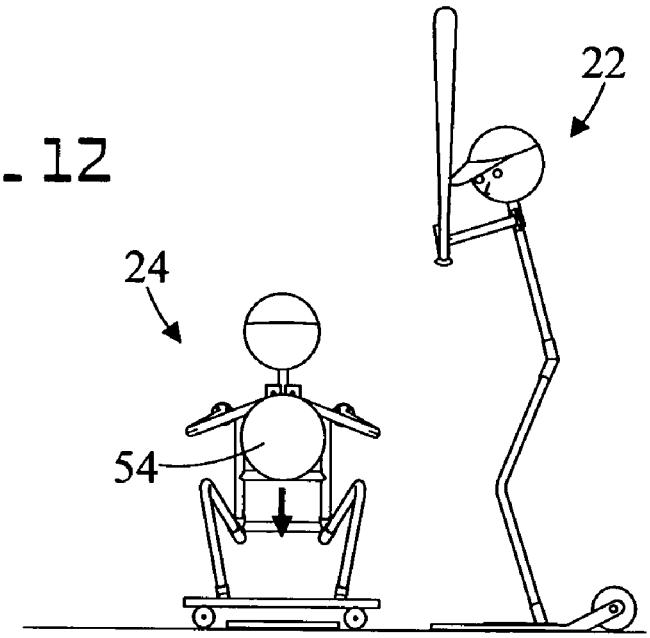
FIG. 12 is a front elevation view of the catcher mannequin's mitt moved down.

Catcher mannequin 24 has a mitt 54 which may be selectively moved in a vertical direction. FIG. 11 is a front elevation view of catcher mannequin's 24 mitt 54 showing it moved up. FIG. 12 is a front elevation view of mitt 54 moved down.

Figure 14:
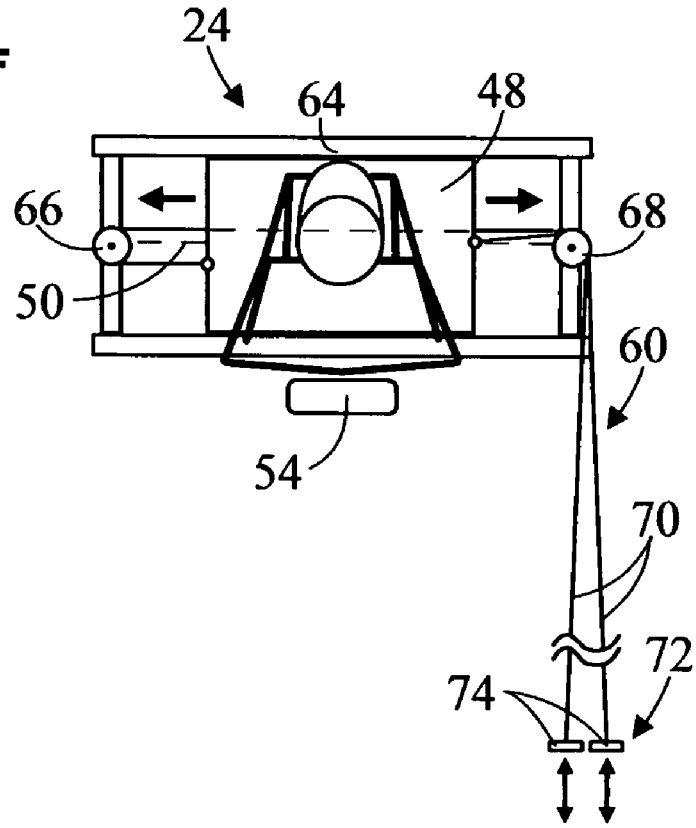
FIG. 14 is a top plan view of a first pulley system for controlling the transverse movement of the catcher mannequin.

FIG. 13 is a reduced top plan view of the system showing a first pulley system 60 for controlling the transverse movement of catcher mannequin 24 and a second pulley system 62 for controlling vertical movement of the catcher mannequin's 24 mitt 54 respectively. FIG. 14 is a top plan view of first pulley system 60 for controlling the transverse movement of catcher mannequin 24. Catcher mannequin 24 resides on second foundation 48 which has wheels 52 (refer to FIGS. 2-4) which roll along transverse path 50. First pulley system 60 includes a frame 64 to which pulley 66 and double pulley 68 are connected. First pulley system also includes pulley cable 70 which terminates in control 72 which has two handles 74. Handles 74 are pulled back and forth in opposite directions to effect the transverse movement of catcher mannequin 24. In an embodiment of the invention, control 72 is disposed at pitching area 28 so that a pitching coach PC (or the practicing pitcher) can control the position of catcher mannequin 24 while being in close proximity to the practicing pitcher (user).

Figure 15:
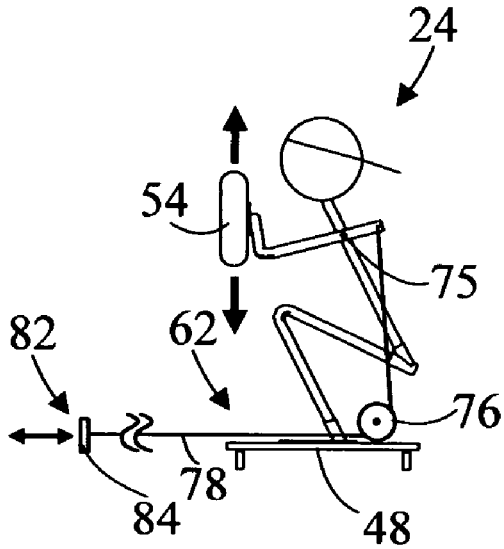
FIG. 15. is a side elevation view of a second pulley system for controlling the vertical movement of the catcher mannequin's mitt.

FIG. 15. is a side elevation view of second pulley system 62 for controlling the vertical movement of catcher mannequin's 24 mitt 54. Second pulley system 62 includes second foundation 48 to which pulley 76 is connected. The arms of catcher mannequin 24 pivot at pivot point 75. Second pulley system 62 causes catcher mannequin's arms to pivot and therefore move mitt 54 up or down. Second pulley system 62 also includes pulley cable 78 which terminates in control 82 which has two handles 44. Handles 84 are pulled back and forth in opposite directions to effect the up and down movement of catcher mannequin's mitt 54. In an embodiment of the invention, control 84 is disposed at pitching area 28 so that a pitching coach PC can control the position of catcher mannequin's 24 mitt 54 while being in close proximity to the practicing pitcher (user).

The aforementioned transverse movement of catcher mannequin 24 coupled with the vertical movement of mitt 54 serve to simulate the positioning of the catcher's mitt as a target for the pitcher.

It may be appreciated that the transverse movement of catcher mannequin 24 and the up and down movement of mitt 54 could also be automatically implemented by numerous electromechanical means which are well known in the mechanical and electrical arts. For example, electrical motors, gears, chain drives, electromechanical actuators, remote controls and the like could be utilized to effect the desired motion.

FIGS. 16 and 17 are side elevation and front elevation views respectively of catcher mannequin 24 and an angled guard 90. Angled guard 90 is disposed in front of second foundation 48 so that pitched balls 30 (refer to FIG. 1) will not strike and damage second foundation 48 and wheels 52. Instead balls 30 will be deflected upward.

FIG. 18 is a side elevation view of elevated pitching platform 34 with a user U practice pitching. Elevated pitching platform 34 includes pitching rubber 38 and downward sloping portion 36.

FIG. 19 is a front elevation view of a filled out batter mannequin 22 wearing a uniform.

FIG. 20 is a side elevation view of a filled out catcher mannequin 24 wearing a uniform.

In terms of use, a method for a user U to practice pitching, includes:

(a) providing a ball 30;

(b) providing a system for practicing pitching 20, system 20 including;

a home plate 26;

a pitching area 28, the user U dispose at pitching area 28;

a batter mannequin 22 disposed upon a first foundation 40 which is not rotatably connected to home plate 26, batter mannequin 22 selectively movable to a right handed batting position or to a left handed batting position;

a catcher mannequin 24 disposed upon a second foundation 48, second foundation 48 disposed behind home plate 26; and, catcher mannequin 24 selectively moveable with respect to home plate 26 along a transverse path 50;

(c) manually moving batter mannequin 22 to one of a right handed batting position and a left handed batting position;

(d) moving catcher mannequin 24 to a desired position along transverse path 50; and, (e) user U throwing ball 30 from pitching area 28 toward home plate 26.

The method further including:

in step (b), first foundation 40 including rolling means for selectively rolling first foundation 40 to either a right side of home plate 26 or to a left side of home plate 26 so that batter mannequin 22 assumes either a right handed batting position or a left handed batting position respectively; and, in step (c), using the rolling means to manually move batter mannequin 22 to one of a right handed batting position and a left handed batting position.

The method further including:

in step (b), batter mannequin 22 having a rotatable head 44, rotatable head 44 manually rotatable to (1) a left-looking position when batter mannequin 22 is in a right handed batting position so that batter mannequin 22 looks at pitching area 28, and to (2) a right-looking position when batter mannequin 22 is in a left handed batting position so that batter mannequin 22 looks at pitching area 28; and, during step (c), rotating rotatable head 44 to a left-looking position if batter mannequin 22 is placed in a right handed batting position, or rotating rotatable head 44 to a right looking position if batter mannequin 22 is placed in a left handed batting position.

The method further including:

during step (c), placing batter mannequin 22 in one of a closed batting stance and an open batting stance.

The method further including:

in step (b), providing a first pulley system 60 for controlling the transverse movement of catcher mannequin 24, first pulley system 60 having a control 72, and control 72 disposed at pitching area 28; and, in step (d), using control 72 of first pulley system 60 to move catcher mannequin 24 to a desired position along transverse path 50.

The method further including:

in step (b), catcher mannequin 24 having a mitt 54, the mitt 54 selectively moveable in a vertical direction;

in step (b), providing a second pulley system 62 for controlling the vertical movement of mitt 54, second pulley system 62 having a control 82, and control 82 disposed at pitching area 28; and, before step (e), using control 82 of second pulley system 62 to move mitt 54 to a desired vertical position.

The preferred embodiments of the invention described herein are exemplary and numerous modifications, variations, and rearrangements can be readily envisioned to achieve an equivalent result, all of which are intended to be embraced within the scope of the appended claims.

I claim:

1. A system for practicing pitching, comprising:

a home plate;

a pitching area;

a batter mannequin disposed upon a first foundation which is not rotatably connected to said home plate, said batter mannequin selectively movable to a right handed batting position or to a left handed batting position;

a catcher mannequin disposed upon a second foundation, said second foundation disposed behind said home plate;

said catcher mannequin selectively moveable with respect to home plate alone a transverse path;

said first foundation including rolling means for selectively rolling said first foundation to either a right side of said home plate or to a left side of said home plate so that said batter mannequin assumes either said right handed batting position or said left handed batting position respectively;

said rolling means including two wheels connected to said first platform;

said pitching area including an elevated pitching platform upon which a user stands;

said elevated pitching platform having a sloping portion which slopes downward toward said home plate;

said batter mannequin having a body which is bilaterally symmetrical about a vertical median plane;

said batter mannequin having hands which are centered out in front of said body and which reside upon said vertical median plane;

said hands holding a bat which is bisected by said vertical median plane;

said batter mannequin having a rotatable head, said rotatable head manually rotatable to (1) a left-looking position when said batter mannequin is in said right handed batting position so that said batter mannequin looks at said pitching area, and (2) a right-looking position when said batter mannequin is in said left handed batting position so that said batter mannequin looks at said pitching area;

said second foundation having wheels for transversely moving said catcher mannequin;

an angled guard disposed in front of said second foundation;

a first pulley system for controlling said transverse movement of said catcher mannequin;

said first pulley system having a control;

said control disposed at said pitching area;

said catcher mannequin having a mitt;

said mitt selectively movable in a vertical direction;

a second pulley system for controlling said vertical movement of said mitt;

said second pulley system having a control; and, said control disposed at said pitching area.

* * * * *

UNITED STATES PATENT AND TRADEMARK OFFICE

CERTIFICATE OF CORRECTION

PATENT NO. : 7,614,967 B1
APPLICATION NO. : 11/980031
DATED : November 10, 2009
INVENTOR(S) : Joseph Edwin Lewis It is certified that error appears in the above-identified patent and that said Letters Patent is hereby corrected as shown below:

In Claim 1, Column 8, Line 21, change "alone" to -- along --.

Signed and Sealed this

Nineteenth Day of January, 2010

David J. Kappos

David J. Kappos
*Director of the United States Patent and Trademark Office*